US005828063A

United States Patent [19]

Köster et al.

[11] Patent Number: 5,828,063

[45] Date of Patent: Oct. 27, 1998

[54] METHOD FOR MATRIX-ASSISTED LASER DESORPTION IONIZATION

[75] Inventors: Claus Köster, Lilienthal; Jochen Franzen, Bremen, both of Germany

[73] Assignee: Bruker-Franzen Analytik, GmbH, Bremen, Germany

[21] Appl. No.: 832,469

[22] Filed: Apr. 2, 1997

[30] Foreign Application Priority Data

Apr. 27, 1996 [DE] Germany ..... 196 17 011.7

[51] Int. Cl.[6] ..... H01J 49/10

[52] U.S. Cl. ..... 250/288

[58] Field of Search ..... 250/288, 288 A, 250/281, 282

[56] References Cited

U.S. PATENT DOCUMENTS

| | | | |
|---|---|---|---|
| 4,527,059 | 7/1985 | Benninghoven et al. | 250/288 |
| 4,920,264 | 4/1990 | Becker | 250/288 |
| 5,118,937 | 6/1992 | Hillenkamp et al. | 250/282 |
| 5,308,978 | 5/1994 | Cottrell et al. | 250/288 |
| 5,506,348 | 4/1996 | Pieles | 536/23.1 |
| 5,589,655 | 12/1996 | Jen Wu et al. | 250/288 |
| 5,663,561 | 9/1997 | Franzen et al. | 250/288 |

FOREIGN PATENT DOCUMENTS

| | | |
|---|---|---|
| 3931287 | 2/1991 | Germany . |
| 4408034 | 7/1995 | Germany . |
| 2299445 | 10/1996 | United Kingdom . |
| 9515001 | 6/1995 | WIPO . |

*Primary Examiner*—Kiet T. Nguyen

[57] ABSTRACT

A method for matrix-assisted ionizing laser desorption of large analyte molecules (MALDI) in a vacuum for the generation of ions for mass spectrometric investigation of the analyte substance is provided. The matrix substance for matrix-assisted ionizing laser desorption is formed from at least two different components. One of the components is very adsorptive, as well as being decomposable thermolytically into small fractions. Additional matrix components are selected for protonation of the analyte molecules. In particular, a thin layer of nitrocellulose (also called cellulose nitrate) with a protonating substance embedded within it is particularly suitable. This layer, which is insoluble in water, adsorbs large analyte molecules from an aqueous solution at its surface.

18 Claims, 1 Drawing Sheet

METHOD FOR MATRIX-ASSISTED LASER DESORPTION IONIZATION

BACKGROUND OF THE INVENTION

The method of mass spectrometric investigation of analyte substances of heavy molecular weight with ionization by laser-induced desorption consists in subjecting the sample support with the analyte substance applied at the surface to a light pulse from a laser, which is focused on the surface of the sample. This light pulse generates ions of the analyte molecules, which are then subjected to mass spectrometric analysis. Time-of-flight mass spectrometers, but also ion storage mass spectrometers such as high frequency quadrupole ion traps, often simply referred to as "ion traps", or ion cyclotron resonance mass spectrometers ("ICR spectrometers") can be used in particular.

For the special case of time-of-flight mass spectrometry the sample support is subjected to a constant high voltage of between 6 and 30 kilovolts, opposite which there is a base electrode at ground potential at a distance between 10 and 20 millimeters. Ionization is performed by a laser pulse with a typical duration of about 4 nanoseconds. The ions are accelerated through the electric field toward the base electrode and they all receive the same kinetic energy. On the other side of the base electrode there is the drift region of the time-of-flight mass spectrometer. At the end of the flight path the ions arriving are detected and since their kinetic energy is identical their mass-dependent time of flight can be used to determine their mass.

When using ion storage mass spectrometers such as quadrupole ion traps or ICR spectrometers the desorptively generated ions are transferred by ion-optical means to the storage cells of the mass spectrometers, where they are analyzed by mass spectrometry.

For the ionization of large analyte molecules by the largely known process of matrix-assisted laser desorption and ionization (MALDI), which has become very widespread in recent years, the large molecules of the analyte on the sample support are embedded in a layer of tiny crystals of a low-molecular weight matrix substance. The laser light pulse causes a small quantity of matrix substance to evaporate virtually instantaneously. The vapor cloud initially takes up virtually the same space as the solid substance, that is, it is subjected to high pressure. The large analyte molecules are also contained in the initially tiny vapor cloud. In forming the vapor cloud a small fraction of the molecules, that is both the matrix and the large analyte molecules, are ionized. Then the vapor cloud expands into the ambient vacuum in an adiabatic and isentropic process in a manner similar to an explosion. As long as there is still contact between the molecules during expansion of the vapor cloud, the large analyte molecules, having lower ionization energies, are ionized by ion molecule reactions at the expense of the smaller matrix ions.

During the adiabatic expansion, the vapor cloud expanding into the vacuum accelerates not only the molecules and ions of the matrix substance but also, due to viscous friction, the molecules and the ions of the analyte. When the cloud expands in a space which is free of electric fields, the ions reach average velocities of approx. 700 meters per second; the velocities are largely independent of the mass of the ions but they have a large velocity spread, which extends from about 200 to 2,000 meters per second. It may be assumed that the neutral molecules also have these velocities.

The large spread of initial velocities during laser induced ionization has a detrimental effect on and restricts the mass resolution of the time-of-flight spectrometers; however, there is a simple method of refocusing the ions temporally and therefore improving resolution. The principle of this method is simple: The ions of the cloud are initially allowed to fly for a brief period in a drift region without any electrical acceleration. The faster ions move further away from the sample support electrode than the slow ones, and the velocity distribution of the ions produces a spatial distribution. Only then is the acceleration of the ions by a homogeneous acceleration field suddenly switched on, that is, a field with a linearly falling acceleration potential is generated. The faster ions are then further away from the sample support electrode, so they are at a slightly lower initial potential for acceleration, which imparts upon them a slightly lower ultimate velocity for the drift section of the time-of-flight spectrometer than the ions which are slower at the beginning. If the delay for commencement of acceleration ("time lag") is selected appropriately, the ions which are slower at the beginning but faster after acceleration can catch up with the ions which are faster at the beginning but slower after acceleration, at the detector. Therefore ions of the same mass are focused, in first order, at the detector in relation to the time of flight. For the other types of mass spectrometry mentioned the spread of initial energies is also detrimental because it impairs the ion capture process in the storage cells. Here there is no method known to improve capture by homogenizing the initial energies.

DISADVANTAGES OF PREVIOUS METHODS

It has so far not been possible to automate the ionization by MALDI because it has not yet been possible to achieve a uniform evaporation and ionization. The crystal layer of the matrix substance is usually obtained by drying a droplet in which the matrix and a small quantity of the analyte are dissolved at the same time. The layer can be equated with a chaotic city in which there are areas with skyscrapers and ones with small villas or even shacks. It is therefore the prior art to observe the layer of matrix crystals with a video microscope and visually look for parts of the crystal layer which look promising. Even during such a visual search for suitable parts one still always has to try out until one finds a suitable part which provides a spectrum of adequate intensity and mass resolution. Other methods with a smooth base layer of matrix substance which provide slightly more uniform results have only become known for a few matrix substances. However, they have not become common because these matrix substances can only be used for selected analytes.

In fact it is not even predictable to date what analyte can be successfully brought together with what matrix. Matrix substances do not include some analyte molecules in the crystals, while in other cases matrix substances are not suitable for the ionization of the analyte molecules. Here too it is a question of trial and error. However, automation necessitates an ionization method which operates satisfactorily on a regular basis irrespective of the type of analytes. No such method has yet been found.

OBJECT OF THE INVENTION

It is the basic objective of the invention to evolve the MALDI method so that automatable sample preparation and automatable ionization are achieved. In particular, it must be possible for the sample to be applied to the sample support automatically without any experimental search for the best matrix substance. Furthermore, it must be possible to expose the sample to the laser beam blindly and without any search for an optimal bombardment point, and it must at the same time achieve ion formation which is optimal for spectral intensity and mass resolution. For time-of-flight mass spectrometry, in particular, a uniform cloud formation should be achieved which creates favorable conditions for improved focusing. All in all the method should provide a high ion yield and therefore a high level of sensitivity to be able to operate with sample quantities of only a few femtomol.

SUMMARY OF THE INVENTION

At present the matrix substance must meet the four following separate requirements simultaneously, whereby only a certain compromise can be achieved in each case:

(1) it must collect the analyte molecules in its crystals individually (not as a molecular cluster) and retain them on the sample support by the fixed crystals;

(2) it must absorb the laser beam light effectively and therefore absorb sufficient energy for instantaneous evaporation within a very short period of time;

(3) during evaporation it must achieve such a high plasma temperature that not too small a fraction of the molecules is ionized—on the other hand, the matrix substance must not lose its properties enabling ionization, by decomposition, for example; and (4) it must then ionize the large analyte molecules by protonation in the ensuing ionization process.

It is the basic idea of this invention to assign these four requirements which the matrix substance has to meet to (at least) two substances.

Splitting up the list of requirements between two substances could, for instance, have the following configuration according to the basic idea of the invention:

(a) a first matrix substance (a so-called binder) takes care of the adsorptive binding of the analyte molecules to a preferably smooth surface, it takes care of the binding to the base, it can preferably take care of energy absorption, and it particularly takes care of the formation of the plasma cloud;

(b) a second matrix substance (an ionizer), which is preferably molecularly dissolved in the first substance, takes care of the ionization of the analyte molecules in the plasma cloud; to help out, it can also take care of energy absorption if this is not performed by the first (or another) matrix substance.

It is another basic idea of this invention that the binder can best perform the function of homogeneous formation of a plasma cloud if the binder molecules decompose explosively into small molecules under laser light bombardment. Here explosives such as trinitrotoluene (TNT), which when heated by the laser beam decompose exothermally into the small molecules of water, carbon monoxide, carbon dioxide, nitrogen, and hydrogen, are particularly suitable.

However, the binder must also be able to meet the requirement of adsorptive binding of the analyte molecules. It is a further idea of this invention to use highly adsorptive polymer structures such as those which are known from adsorption columns for cleaning high-molecular organic substances or from blot membranes for blotting 2D-electrophoretic separation.

An excellent combination of a highly adsorptive, polymer-structured substance with the desired explosive property is nitrocellulose (or more correctly termed: cellulose nitrate with the DIN abbreviation CN), the explosiveness of which can also be adjusted by the degree of nitration. Where the content of nitrogen is between 10.5% and 12.5% the substance is referred to as cellulose dinitrate (collodion cotton) and where the nitrogen content is between 12.5% and 14.14% the substance is called cellulose trinitrate (gun cotton). Both types deflagrate upon heating, and the violence of deflagration is directly proportional to the degree of nitration. Cellulose nitrates consist of approx. 100 to 3,500 partially to fully nitrated glucose units.

The binder may, but does not necessarily have to, assume the task of light absorption. This task may be handled by derivatization of the cellulose nitrate, whereby absorptive molecule groups can be embedded into the cellulose structure. By selecting the molecule groups it is possible to adapt to the wavelength of the laser used. However, it is also possible to assign this task to a third matrix substance. Cellulose nitrate is excellent for dyeing and can therefore be made nontransparent for all wavelengths.

It is a further idea of this invention to apply the cellulose nitrate dissolved in acetone to the sample support in the form of a layer of lacquer. This produces a uniform layer, which is the basic prerequisite for automatability of sample preparation and ionization. Cellulose nitrate is used to manufacture nitrocellulose-based lacquers. Nitrocellulose-based lacquers usually have the less nitrated cellulose dinitrate as their base.

The cellulose basic structure is particularly favorable for the surface binding of the analyte molecules on account of their particularly strong adsorptiveness. Since nitrocellulose is not soluble in water, one can very simply apply proteins, water-soluble polymers and other large-molecular analytes to the lacquer layer from an aqueous solution. Nitrocellulose is frequently used for blot membranes; compared with other, usually more expensive blot membranes it has the disadvantage that the analyte molecules cling very tightly to the surface, and too tightly for many methods of an analysis. In the present case this drawback is an advantage. The aqueous solution of high-molecular analytes such as proteins contains not only the analyte molecules but frequently also stabilizing buffer salts and other constituents harmful to the ionization process. The firm adhesion of the analyte molecules and the insolubility of nitrocellulose in water permits easy and low-loss washing of the applied large-molecular analyte.

Explosives with their exothermic decomposition also simultaneously lead to a very constant cloud formation; small energy differences in the beam of laser light are of minor significance. The explosive is applied so thinly (in some cases only fractions of a micrometer) that autogenous afterburning in the adjacent areas does not take place because the sample support has an intense cooling effect and quenches combustion. By contrast with normal MALDI, where a laser light focus diameter of 100 to 200 micrometers is preferred to erode a thin layer of the matrix surface over a large area, with explosive MALDI it is possible to use focus diameters of between 3 and 10 micrometers. Within this diameter the entire layer is eroded down to the sample support underneath.

Application of the analyte molecules to the surface of the layer of lacquer also has the advantage that the ions of the analyte molecules thus formed have a much smaller spread of initial velocities after expansion of the cloud. The ions can therefore be much more efficiently captured in storage cells of ion storage mass spectrometers.

For certain applications, however, the quantity of analyte molecules which can be bound to the surface adsorptively is too small. It is a further idea of this invention to increase the surface of the layer by taking special measures to enlarge the receiving capabilities for large molecules. There are different methods available. The thin layer of lacquer can for example be allowed to swell by means of suitable solvents (for example by a water/alcohol mixture). The swelling process is slow and takes several days. A latticed gel with cavernous cavities is formed. By careful drying (for example by freeze-drying) a highly porous layer can then be created which, due to its large surface area, can absorb a high quantity (a multiple) of the analyte.

To make the applied layer insoluble even to nonaqueous solvents, it is particularly advantageous to cross-link the usually threadlike molecules of the layer of lacquer by adding a bridge forming agent after application to the sample support. For cross-linking cellulose nitrate, diisocyanate, which combines the remaining OH groups of adjacent molecular strings with one another, has proved reliable. This cross-linking prevents solubility but not swellability. The cross-linking does not prevent the ability of the cellulose nitrate to decompose when subjected to the laser beam.

A different method uses highly porous, very fine powder from cellulose nitrate which is applied to the sample support. For example, this can take place by dusting a layer of adhesive, whereby the layer of adhesive can, for instance, be also based on cellulose nitrate.

A porous layer on an electrically conductive sample support can, for example, also be used for blotting a substance mixture separated by 2-dimensional gel electrophoresis. 2-dimensional scanning by MALDI produces an increase in sensitivity compared with conventional methods of dyeing, which is several orders of magnitude and additionally provides reliable information about the molecular weight.

The second matrix component, the ionizer, can now be chosen according to requirements. Generally its only task is to ionize the analyte molecules. The ionizer must be capable of being dissolved in the lacquer of the binder. If, for example, acetone is used as a solvent for the binder for making a lacquer, the ionizer should also be soluble in acetone.

Experimentation has demonstrated that the concentration of the ionizer does not need to be high. Our tests, however, have been restricted to alpha-cyano-4-hydroxi-cinnamic acid (abbreviated to "Alpha-Cyano"). With about 10% Alpha-Cyano in 90% nitrocellulose a virtually clear lacquer is obtained which can be applied very thinly. It forms a good base for ionization of practically all types of proteins which can be easily applied to the surface of the lacquer insoluble in water from an aqueous solution. However, it is to be expected that the search for better ionizers will soon produce results which will very considerably increase the yield of analysis ions, which is currently about 1/10,000.

If we disregard blotting, the analyte molecules are usually simply applied to the adsorptive layer by applying a tiny droplet of analyte solution. Frequently the droplet does not even have to dry-after adsorption of the analyte molecules the remainder can be simply washed off. This is particularly advantageous because in this way even disturbing buffer substances and salts in the solutions can be eliminated.

For highly diluted analytes where an applied drop does not contain sufficient molecules for mass spectrometric analysis a different type of sample support has proved reliable. The adsorptive matrix layer is applied to the surface of tiny magnetic beads. In this case it is particularly advantageous to make the matrix layer completely insoluble by cross-linking. A small number of the beads is then added to the highly diluted analysis solution. By lengthy contact with agitation the analyte molecules can, in this way, be practically bound to the surface of the beads quantitatively by the adsorption process. The beads can then be extracted from the solution by special magnetic tools and applied to a flat sample support surface. There they can be attached by magnetic forces, by superimposed very fine grids or simply by adhesive bonding. After transfer to the vacuum they are directly bombarded by laser light and provide an excellent MALDI.

The beads can be very effectively used if only very small quantities of analyte are available because they can adsorb the analyte molecules almost completely even from highly diluted solutions or from very small volumes. The solution does not have to be pipetted or transferred in any other manner so losses due to wall adsorption are kept to a minimum. In this way even analytes from single biological cells can be fed to a mass spectrometric analysis.

The previously used MALDI method essentially required irradiation of the sample support from the sample side because only a very small matrix quantity evaporated at the surface in each case, that is, only a fraction of the layer thickness was eroded in each case. The use of magnetic beads also calls for bombardment from the sample side because the beads are not transparent.

If, however, flat sample supports are used, a different method can be applied because the use of a thin layer of explosive lacquer causes complete evaporation of a small area of the layer so a bare part of the sample support remains. It is therefore a further idea of the invention to irradiate and therefore evaporate the matrix layer from the rear of a sample support which is permeable to laser radiation. The rear of the sample support is much more accessible than the front, on which the acceleration and focusing diaphragms, with their high voltages, prevent vertical bombardment or bombardment with a short focal length and make it necessary to use very complex designs.

Since the focal diameter can be very much smaller than for normal MALDI, the power of the laser can be very much lower. Compared with the gas lasers generally used nowadays the total radiation energy can be 100 to 1,000 times smaller, depending on the reduced area. Therefore much weaker laser systems can be used. Consequently it is a further idea of this invention to use simple diode pulse lasers, as used for writable Compact Discs (CD). When using transparent sample supports such a diode pulse laser can very easily be installed at the back of the sample support.

Using diode pulse lasers at the rear of the sample support produces further advantages. Firstly, the lens, which is used for focusing, is not soiled. Secondly, a lens with a very short focal distance can be used, so the focal spot can be very small even if the beam quality of the diode laser is only moderate.

The wavelength of the laser, which was always extremely important with previous MALDI methods and also governed selection of the matrix substances, is only of secondary importance because the only purpose of the laser beam is to ignite the explosive.

DESCRIPTION OF THE PREFERRED EMBODIMENT

Figure 1:
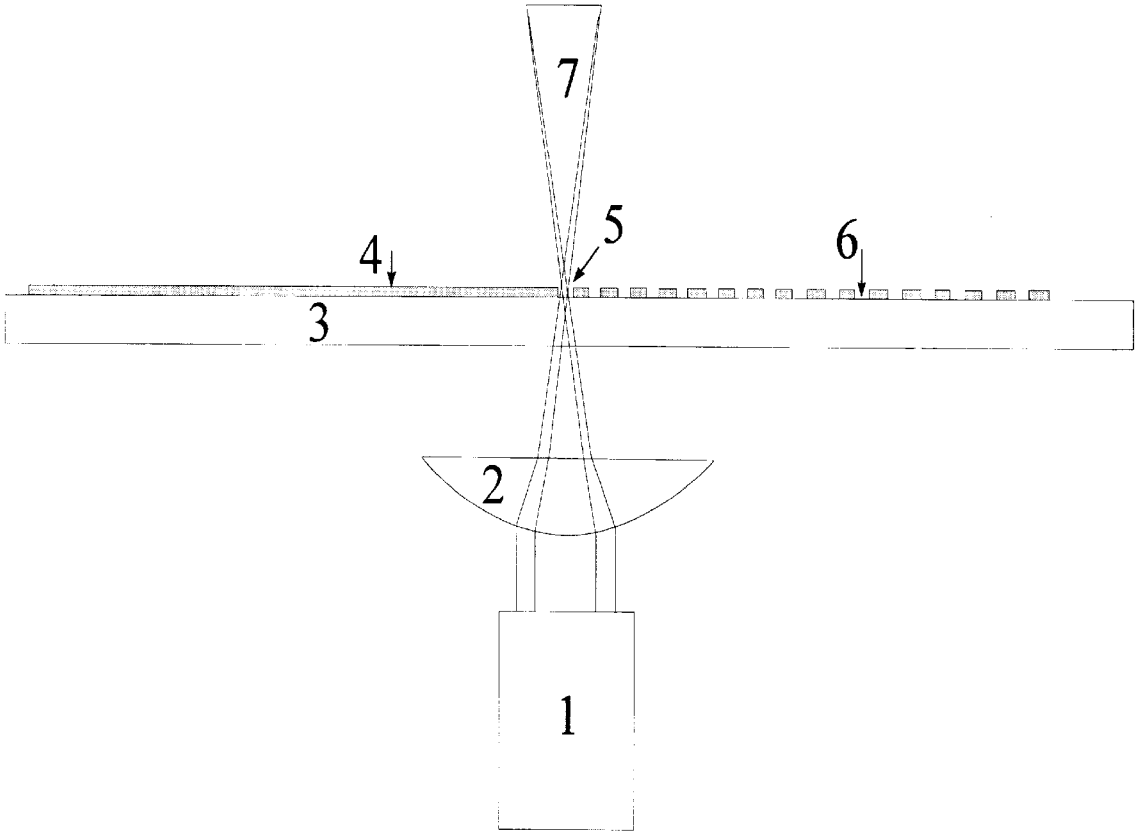
FIG. 1 shows an arrangement with a layer of lacquer 4 of cellulose nitrate with 10% Alpha-Cyano-4-Hydroxi-Cinnamic acid on a mobile sample support 3, which is permeable to the laser light beam 7 from diode laser 1. A lens 2 generates at position 5 a focus which, despite inferior beam quality, has a diameter of only approx. 10 micrometers. At this point the cellulose nitrate deflagrates and forms a cloud of low-molecular substances with a portion of ionized Alpha-Cyano. In the vapor cloud the monomolecular layer of analyte molecules applied to the surface of lacquer layer 4 is ionized by ions of the matrix substance Alpha-Cyano. At positions 6 parts of the matrix layer have already been removed in preceding steps of the method.

The basic version of the method according to this invention is shown in FIG. 1.

A laser light pulse of about 5 nanoseconds duration from a diode pulse laser 1 is focused on matrix layer 4 by means of lens 2 through the transparent sample support 3. This matrix lacquer layer 4 is made of cellulose nitrate with 10% Alpha-Cyano-4-Hydroxi-Cinnamic acid, it is only about 0.5 micrometers thick. The diameter of the focus at focal point 5 is about 10 micrometers due to the inevitable beam quality failures. Part of the laser light is absorbed by matrix layer 4 and leads to deflagration of the cellulose nitrate, a further small portion 7 of the laser light passes through and disappears. The cloud generated by the deflagration of the cellulose nitrate and made up of low-molecular gases also contains the scattered molecules of the protonation substance Alpha-Cyano-4-Hydroxi-Cinnamic acid, which are partially ionized because of the high plasma temperature. These ions react with the also scattered molecules of the analyte and protonate them. The analysis ions are fed to the mass spectrometer for analysis in the usual manner.

The sample support can be moved parallel to its surface, by a moving device not illustrated. Holes 6 in the matrix layer are focal spots generated in preceding cycles of analysis, in which the matrix layer has completely deflagrated. The measured values from these preceding cycles of analysis are usually added into a digital memory and after a few cycles they provide a mass spectrum with an improved signal-to-noise ratio.

One of the most significant results of a mass spectrometric analysis is the molecular weight of the analyte examined. If the analytical task is reduced to the definition of molecular weight, about 100 ions, which are measured at the detector and already produce a significant mass peak, constitute an adequate minimum (assuming good mass resolution). If one assumes that only one fifth of the analyte molecules applied to the lacquer layer can be used and if one conservatively expects an ion yield of only 1/10,000 measured ions per analyte molecule input, about 5 million molecules of analyte will be required for this determination of molecular weight. If the analyte molecules are located at a spot with a size of 100×100 micrometers, this produces a coverage of between 1/100 and 1/1,000 of a mono-molecular layer. The quantity input corresponds to about 10 attomol of analyte. The analysis requires bout 20 to 40 laser light bombardments each with a laser light focal diameter of approx. 10 micrometers. The total scanning time is only about 1 to 2 seconds at 20 laser light bombardments per second. These figures constitute a lower limit. For routine analysis one can expect 10 to 100 times the substance input, that is, about 100 attomols to 1 femtomol. However, this only applies assuming that the ionization yield cannot be increased, for example, due to the discovery of a more suitable ionization substance the use of which is made possible by this invention.

We claim:

1. A method of generating ions from large analyte molecules on a sample support in a vacuum by matrix-assisted laser desorption (MALDI), the method comprising:

a) depositing, on a sample support, a mixture having a plurality of components, wherein one of said components is both of a relatively high adsorbtivity for the analyte molecules, and is decomposable by laser light used for said laser desorption;

b) depositing the analyte molecules on the matrix mixture; and c) desorbing and ionizing the analyte molecules with said laser light so as to decompose the decomposable component of the matrix mixture.

2. A method according to claim 1, wherein depositing a matrix mixture comprises depositing a matrix mixture that includes a non-decomposing, protonating matrix component.

3. A method according to claim 1, wherein depositing a matrix mixture comprises depositing a matrix mixture that includes a further matrix component that colors the matrix and makes it absorptive for the laser light used.

4. A method according to claim 1, wherein depositing a matrix mixture comprises depositing a matrix mixture that includes an explosive substance.

5. A method according to claim 1, wherein depositing a matrix mixture comprises depositing a matrix mixture that includes cellulose nitrate.

6. A method according to claim 5, wherein depositing a matrix mixture that includes cellulose nitrate comprises depositing a matrix mixture that includes cellulose nitrate with an optimal degree of nitration between 11.5% and 13.5% nitrogen.

7. A method according to claim 1, wherein depositing a matrix mixture comprises depositing a matrix mixture having components that form a solid, common solution.

8. A method according to claim 1, wherein depositing a matrix mixture comprises depositing a matrix mixture as a layer of lacquer.

9. A method according to claim 8, wherein depositing a matrix mixture as a layer of lacquer comprises depositing a layer of lacquer which is 3-dimensionally cross-linked by a bridge-forming agent after application to the sample support.

10. A method according to claim 9, wherein depositing a layer of lacquer which is 3-dimensionally cross-linked by a bridge-forming agent after application to the sample support comprises using diisocyanate as the bridge-forming agent.

11. A method according to claim 8 further comprising transforming the layer of lacquer to a highly porous layer by swelling and drying.

12. A method according to claim 11, wherein depositing the analyte molecules comprises depositing the analyte molecules by adsorption from a solution.

13. A method according to claim 11, wherein depositing the analyte molecules comprises depositing the analyte molecules by blotting.

14. A method according to claim 1, wherein depositing a matrix mixture comprises depositing cellulose nitrate as a highly porous powder on the sample support in a thin layer.

15. A method according to claim 1 further comprising providing the sample support such that it is transparent for the wavelength of laser light used and the laser beam is admitted from the rear of the sample support.

16. A method according to claim 15 further comprising generating the laser light with a diode pulse laser.

17. A method according to claim 1 further comprising providing the sample support such that it includes small magnetic beads.

18. A method according to claim 17, wherein providing the sample support such that it includes small magnetic beads comprises adding the magnetic beads to a solution of analyte molecules for adsorptive charging with analyte molecules, fishing them out through a magnetic field, and applying them to a sample support base plate.

* * * * *